United States Patent [19]

Duncan, III et al.

[11] Patent Number: 4,503,668

[45] Date of Patent: Mar. 12, 1985

[54] STRUTLESS DIFFUSER FOR GAS TURBINE ENGINE

[75] Inventors: Garland H. Duncan, III, Tequesta; David L. Cooper, North Palm Beach, both of Fla.

[73] Assignee: The United States of America as represented by the Secretary of the Air Force, Washington, D.C.

[21] Appl. No.: 484,390

[22] Filed: Apr. 12, 1983

[51] Int. Cl.[3] ..... F02C 7/20

[52] U.S. Cl. ..... 60/39.32; 60/751; 415/118

[58] Field of Search ..... 60/751, 39.32, 39.31, 60/39.27, 39.29; 415/118, 27, 28, 207, 211; 73/756

[56] References Cited

U.S. PATENT DOCUMENTS

| | | | |
|---|---|---|---|
| 2,640,319 | 6/1953 | Wislicenus | 60/39.66 |
| 2,870,632 | 1/1959 | Gaubatz | 415/118 X |
| 3,463,498 | 8/1969 | Bill | 60/39.32 |
| 3,493,169 | 2/1970 | Abild et al. | 230/119 |
| 3,879,940 | 4/1975 | Stenger et al. | 60/39.32 X |
| 4,098,074 | 7/1978 | Greenberg et al. | 60/39.36 |
| 4,098,075 | 7/1978 | Greenberg et al. | 60/39.36 |
| 4,177,637 | 12/1979 | Pask | 60/751 X |
| 4,180,972 | 1/1980 | Herman et al. | 60/39.32 |
| 4,416,111 | 11/1983 | Lenahan et al. | 60/39.29 |

FOREIGN PATENT DOCUMENTS

| | | | |
|---|---|---|---|
| 2036459 | 2/1971 | Fed. Rep. of Germany | 60/751 |

*Primary Examiner*—Carlton R. Croyle
*Assistant Examiner*—Jeffrey A. Simenauer
*Attorney, Agent, or Firm*—Donald J. Singer; Stanton E. Collier

[57] ABSTRACT

An improved diffuser for a gas turbine engine is mounted between a compressor section and a burner section. The diffuser eliminates struts by using the exit guide vanes of the compressor for support. The vanes are fixedly mounted to an inner case wall and to a double outer wall. A cantilevered case wall being one of the double outer walls can flex both radially and axially to relieve thermal stress in the vanes. Additionally, probes can be mounted in access ports formed in the double outer wall. Compressor leakage gas is prevented from entering voids in the double outer wall by a seal seated between the cantilevered case wall and the outer case wall.

3 Claims, 5 Drawing Figures

FIG. 1
PRIOR ART
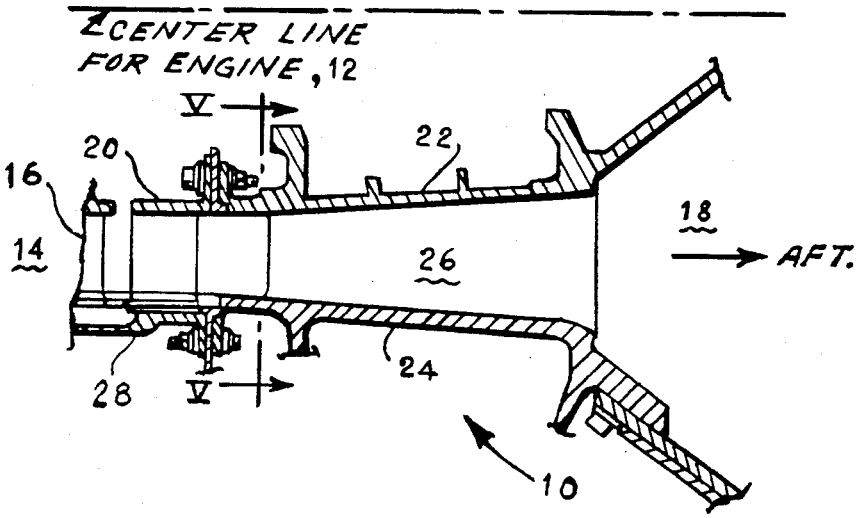
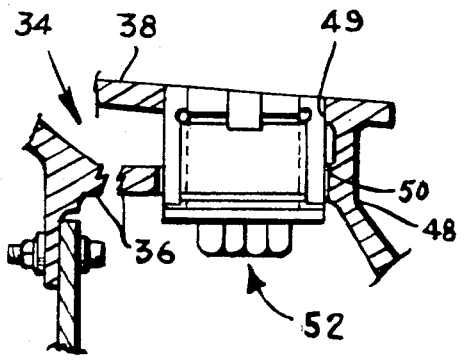
FIG. 3

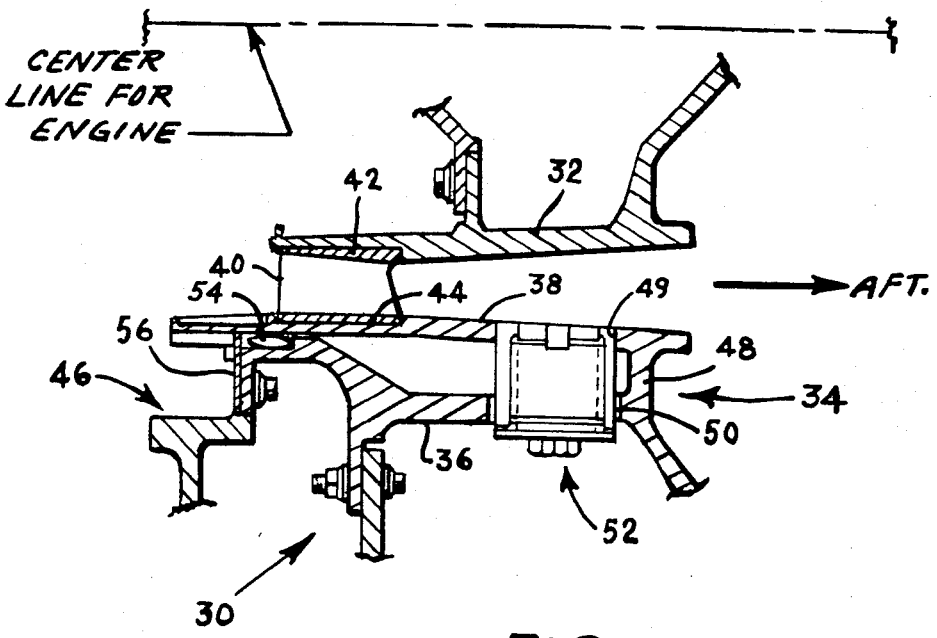
FIG. 2
FIG. 4
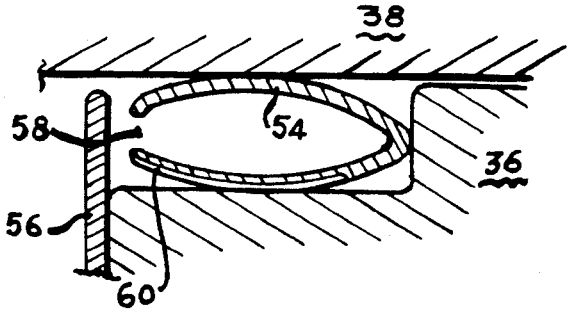
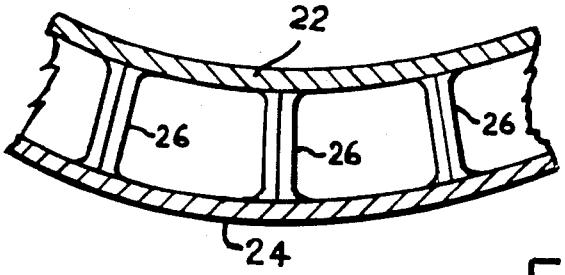
FIG. 5

STRUTLESS DIFFUSER FOR GAS TURBINE ENGINE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to gas turbine engines, and, more particularly, relates to a diffuser case for a gas turbine engine combustor.

In a conventional axial flow gas turbine, air from the compressor section enters a diffuser of a combustor through a set of exit guide vanes. From the combustor, the air drives the turbine mounted immediately downstream thereof. The diffuser has basically an inner and outer case wall held together structurally by struts positioned in the annular flowpath between the inner and outer case walls. A flow splitter can also be positioned in or after the annular passage to divert air for cooling or other purposes. The thermal response of the outer case wall of the diffuser and the compressor are not compatible with the the response of the diffuser inner case wall. As a result of this incompatability, the connecting struts must be of substantial size to carry the resultant load. Additionally, the compressor's exit guide vanes must be floated in their mountings to avoid overstress under the above circumstances.

An example of a gas turbine combustor is shown in U.S. Pat. No. 4,098,074, entitled, "Combustor Diffuser For Turbine Type Power Plant and Construction Thereof", assigned to United Technologies Corporation. This particular diffuser has a splitter for diverting air to a burner and to a cooling section. In the passage leading to the burner section struts are connected to the inner case wall and to the splitter. Additional structural struts are formed between the splitter and the outer case wall in the cooling section. Struts placed in the passages impede the flow of air therethrough and thus the efficiency of the gas turbine. These connecting struts further add to the engine weight.

The present invention is directed toward a diffuser providing higher efficiency in which these undesirable characteristics are eliminated.

SUMMARY OF THE INVENTION

The present invention overcomes the problems encountered in the past and described in detail hereinabove by providing a double wall, cantilevered, strutless diffuser for a gas turbine engine combustor which is capable of providing more even thermal response, a lower weight, and higher efficiency.

The diffuser of the present invention is constructed of the combustor inner case wall, the exit guide vanes attached to the combustor inner case wall, and also attached to the third element the double outer wall.

The exit guide vanes, now being used for structural support, are attached to the combuster inner case wall and to the cantilevered case wall of the double outer case. A special seal is positioned between the cantilevered case wall and the outer case wall to prevent gas flow into instrumentation and access ports in the diffuser double outer wall. By the above arrangement, the exit guide vanes act as structural support for the combustor's inner case wall.

The substitution of the exit guide vanes for the struts which were previously downstream and the mounting of the exit guide vanes on the cantilevered case wall allow for uniform thermal response of the exit guide vanes of the combustor inner case wall and of the cantilevered case wall thus preventing thermal stress in the exit guide vaines being used as structural elements therebetween. Further, the cantilevered case wall can flex both in the axial as well as radial direction to further relieve stress in the exit guide vanes.

It is therefore one object of the present invention to provide for a diffuser having no support struts in the flowpath;

It is a further object of the present invention to provide for a diffuser having a double outer wall and cantilevered case wall thereof to provide even thermal response;

It is a still further object of the present invention to provide for a seal mounted in the double outer wall to prevent leakage around the last rotor tip shroud;

It is a still further object of the present invention to provide instrumentation and access ports through the double outer wall strutless diffuser.

These and many other objects and advantages of the present invention will be readily apparent to one skilled in the pertinent art from the following detailed description of a preferred embodiment of the invention and related drawings.

BRIEF DESCRIPTION OF THE DRAWINGS

FIG. 1 is a partial cross section of a prior art diffuser with an exit guide vane of a compressor section connected therein;

FIG. 2 is a partial cross section of the double wall, cantilevered, strutless diffuser of this invention;

FIG. 3 is a partial cross section of an instrumentation probe mounted in access ports in the double outer wall of the diffuser of this invention;

FIG. 4 is an enlarged view of the seal shown in FIG. 2; and

FIG. 5 is a cross section view of the struts of the prior art diffuser of FIG. 1 taken along lines V—V.

DESCRIPTION OF THE PREFERRED EMBODIMENT

A prior diffuser 10 is shown partially in FIG. 1. Diffuser 10 is ring shaped and centered on an engine centerline 12. Diffuser 10 controls the flow of air from a conventional compressor 14 to a conventional burner 18, not shown; a single rotor blade 16 of compressor 14 and a single exit guide vane 20 of compressor 14 are shown. The air entering burner 18 can be directed totally into burner 18, not shown, or into a cooling section, also not shown. A conventional diffuser is partially shown in U.S. Pat. No. 4,098,074, entitled "Combustor Diffuser For Turbine Type Power Plant and Construction Thereof."

Again referring to FIG. 1, the air after flowing past exit guide vane 20 enters diffuser 10 constructed of an inner case wall 22, an outer case wall 24 with a strut 26 connecting walls 22 and 24. A compressor outer wall 28 is bolted to outer case wall 24. Because the thermal response of outer walls 24 and 28 are not compatable with inner case wall 22, strut 26 must be of substantial size to carry the resultant load. This, of course, also impedes the flow of air through diffuser 10. Further, exit guide vane 20 must be "floated" to avoid overstress under the above circumstances. Although only one strut 26 is shown in FIG. 1, there are in fact, as shown in FIG. 5, a plurality of struts 26 positioned about the entire centerline between inner case wall 22 and outer case wall 24.

In contrast to the prior diffuser 10 shown in FIG. 1, a diffuser 30 of the present invention is shown in FIG. 2.

Diffuser 30 is constructed of an inner case wall 32, a double outer wall 34 being made up of a cantilevered case wall 38 and an outer case wall 36, an instrumentation probe 52 mounted in double outer wall 34, and multiple exit guide vanes 40, only one exit guide vane 40 shown in FIG. 2.

The materials of diffuser 30 are conventional as well as the means of connecting the items together except where noted.

In order to replace strut 26 of diffuser 10 with vane 40, vane 40 is no longer floated and is then welded to inner case wall 32 at a joint 42 and to cantilevered case wall 38 at a joint 44. This provides the needed structural connection between walls 32 and 38.

Since vane 40 is substantially less massive than strut 26, means for reducing thermal incompatability is required to stop catastrophic failure of vane 40.

To achieve thermal compatibility, double outer wall 34 replaces the more massive prior outer case wall 24 such that cantilevered case wall 38 is constructed substantially similar to inner case wall 32 so that both follow, temperature wise, compressor 14 exit gas temperature. In contrast to the temperature of the exit gas, ambient air bathes a compressor outer case wall 46 and diffuser outer case wall 36, both responding to temperature similarly. In order to relieve the thermal load between cantilevered case wall 38 and outer case wall 36, a connecting wall 48 is remotely located from vane 40. Connecting wall 48 allows cantilevered case wall 38 to flex both radially and axially while under load.

An additional feature of the invention is the necessity of having instrumentation probes and access ports in diffuser 30 outer case walls 36 and 38. In conventional diffuser 10, the access port can be placed in outer case wall 24 and the probe mounted therein.

The means for accomplishing this in the present invention is shown in FIG. 1 which is an enlarged view of probe 52 in double outer wall 34 of FIG. 2. An inner port 49 is made in cantilevered case wall 38, and an outer port 50 is made in outer case wall 36 so that a probe 52 can be mounted therein. Because of both the axial and radial movement between walls 36 and 38, probe 52 is welded or screwed only into inner port 49 and has a small gap between outer port 50 and probe 52 so there is independence between walls 36 and 38 except for connecting wall 48.

The gap between probe 52 and outer port 50, shown in FIG. 3, requires a seal 54 between cantilevered case wall 38 and outer case wall 36 as shown in FIGS. 2 and 4. An enlarged view of seal 54 is shown in FIG. 4. Seal 54 prevents gas leakage from around the last rotor tip shroud, not shown, while allowing cantilevered case wall 38 to flex relative to outer case wall 36 in both the axial and radial direction. Seal 54 has a oval cross section and thus accepts a sizable radial deflection without permanent deformation and also resists twisting due to the relative axial deflection of walls 36 and 38. Seal 54 is held in place by a seal plate 56 bolted to wall 36. Because the C-shaped seal 54 has its opening 58 facing the flow of leakage gas, seal 54 is self-energizing since the upstream pressure tends to spread seal 54 against walls 36 and 38. Multiple slots 60, only one shown in FIG. 4, prevent buckling during assembly.

Clearly, many modifications and variations of the present invention are possible in light of the above teachings and it is therefore understood, that within the inventive scope of the inventive concept, the invention may be practiced otherwise than specifically claimed.

What is claimed is:

1. An improved diffuser for a gas turbine engine, said improved diffuser mounted between a compressor section and a burner section of said gas turbine engine, said improved diffuser comprising:

an inner case wall, said inner case wall being annular shaped and centered about an engine centerline of said gas turbine engine;

a double outer wall, said double outer wall having a cantilevered case wall and an outer case wall, said cantilevered case wall connected at one end by a connecting wall to said outer case wall, said cantilevered case wall forming an annular flowpath with said inner case wall, said flow path allowing compressed air to flow therethrough from said compressor section to said burner section;

a plurality of exit guide vanes fixedly attached to said inner case wall and to said cantilevered case wall, said vanes acting as structural support between said cantilevered case wall and said inner case wall, said cantilevered case wall having said vanes mounted proximal to said compressor section and a connecting wall distally located from the said compressor section and unitarily connected to said cantilevered case wall and said outer case wall such that said cantilevered case wall flexes in response to gas pressure and gas temperature, said double outer wall having an annular void formed between said cantilevered case wall and said outer case wall; and said improved diffuser including a probe mounted in said double outer wall and a seal mounted between said cantilevered case wall and said outer case wall near said vanes for preventing compressor gas leakage from entering said annular void.

2. An improved diffuser as defined in claim 1 wherein said double outer wall has an inner port in said cantilevered case wall and an outer port in said outer case wall, said probe being fixedly mounted in said inner port and spaced apart from said outer port so that said cantilevered case wall and said outer case wall are only connected by said connecting wall.

3. An improved diffuser as defined in claim 2 wherein said seal has an annular shaped lateral cross section and a C-shaped oval longitudinal cross section, said seal seated in an annular rectangular channel, said channel having two adjacent walls in said outer case wall and a third wall on said cantilevered case wall.

* * * * *